US006085143A

United States Patent [19]

Przymusinski et al.

[11] Patent Number: 6,085,143

[45] Date of Patent: Jul. 4, 2000

[54] METHOD FOR REGULATING A SMOOTH RUNNING OF AN INTERNAL COMBUSTION ENGINE

[75] Inventors: Achim Przymusinski; Andreas Hartke, both of Regensburg; Dirk Heinitz, Schönhofen, all of Germany

[73] Assignee: Siemens Aktiengesellschaft, Munich, Germany

[21] Appl. No.: 09/158,253

[22] Filed: Sep. 22, 1998

[30] Foreign Application Priority Data

Sep. 23, 1997 [DE] Germany ..... 197 41 965

[51] Int. Cl.[7] ..... F02D 41/14; F02D 41/04

[52] U.S. Cl. ..... 701/110; 701/111; 123/436

[58] Field of Search ..... 123/339.2, 352, 123/436; 701/110, 111

[56] References Cited

U.S. PATENT DOCUMENTS

| | | | |
|---|---|---|---|
| 4,638,778 | 1/1987 | Kamei et al. | 123/339.2 |
| 4,785,780 | 11/1988 | Di Nunzio et al. | 123/339.2 |
| 5,269,271 | 12/1993 | Kawai et al. | 123/339.2 |
| 5,385,129 | 1/1995 | Eyberg | 123/436 |
| 5,699,252 | 12/1997 | Citron et al. | 701/111 |
| 5,752,213 | 5/1998 | Bryant et al. | 701/111 |
| 5,771,482 | 6/1998 | Rizzoni | 701/110 |
| 5,806,014 | 9/1998 | Remboski et al. | 701/110 |
| 5,809,969 | 9/1998 | Fiaschetti et al. | 701/110 |
| 5,921,221 | 7/1999 | Davis, Jr. et al. | 701/111 |

FOREIGN PATENT DOCUMENTS

| | | |
|---|---|---|
| 38 02 274 A1 | 8/1989 | Germany . |
| 41 40 527 A1 | 8/1992 | Germany . |
| 41 22 139 A1 | 1/1993 | Germany . |
| 36 05 282 C2 | 7/1993 | Germany . |
| 43 41 132 A1 | 6/1994 | Germany . |
| 196 424 A1 | 6/1997 | Germany . |
| 36 03 137 A1 | 8/1998 | Germany . |

*Primary Examiner*—Willis R. Wolfe

*Attorney, Agent, or Firm*—Herbert L. Lerner; Laurence A. Greenberg; Werner H. Stemer

[57] ABSTRACT

A method for regulating the smooth running of a multicylinder internal combustion engine. An inverse linear path model estimates a characteristic process variable from state variables of the internal combustion engine, that is to say actual values, in particular engine speed, fuel quantity, operating temperature, charging pressure, etc. A desired value is compared with the actual value that is determined from state variables of the internal combustion engine by a measuring element. The actual value shows the rotational acceleration contribution of each cylinder. The difference between the actual value and the desired value is supplied to a controller that corrects the combustion in the individual cylinders in such a way that the actual value approaches the desired value. This ensures that the regulation for the smooth running of the engine takes effect both for stationary and non-stationary operating phases of the internal combustion engine.

8 Claims, 4 Drawing Sheets

METHOD FOR REGULATING A SMOOTH RUNNING OF AN INTERNAL COMBUSTION ENGINE

BACKGROUND OF THE INVENTION

1. Field of the Invention

The invention relates to a method for regulating a smooth running of a multi-cylinder internal combustion engine by recording a rotational acceleration of each individual cylinder and compensating for deviations between the individual cylinders by changing a fuel quantity allocated to each individual cylinder.

When an internal combustion engine is running, irregularities in rotation occur which are caused by systematic errors in the fuel metering system and in the internal combustion engine itself. Due to the deviations, the individual cylinders make different contributions to the output torque. In this case, inter alia, tolerances in the engine, in particular in individual injection components, play a part, but these can be reduced only at a particularly high outlay. The different torque contributions of the individual cylinders have the effect, in the stationary mode (for example, during idling) of causing the vehicle to vibrate. In the non-stationary mode, the different increases in torque lead to irregular acceleration and impairment of the exhaust gas values. Published, Non-Prosecuted German Patent Application DE 41 22 139 A1 discloses a method, in which the rotational acceleration of each individual cylinder is recorded and deviations between the individual cylinders are compensated for by changing the fuel quantities allocated to the cylinders.

SUMMARY OF THE INVENTION

It is accordingly an object of the invention to provide a method for regulating a smooth running internal combustion engine which overcomes the above-mentioned disadvantages of the prior art methods of this general type.

With the foregoing and other objects in view there is provided, in accordance with the invention, a method for regulating a smooth running of a multi-cylinder internal combustion engine, which includes: measuring continuously determined state variables of an internal combustion engine having individual cylinders; using the state variables in a model for estimating a characteristic process variable representing a desired value for regulating the internal combustion engine; determining an instantaneous actual value from the state variables corresponding to the desired value, the actual value taking into account a rotational acceleration contribution of each of the individual cylinders; deriving a regulating difference from the desired value and the actual value; transmitting the regulating difference to a controller; and correcting with the controller a combustion in the individual cylinders to minimize the regulating difference.

The method according to the invention discloses a process model which, from the continuously determined state variables of the internal combustion engine, estimates a characteristic process variable which represents the desired value for regulating the engine. State variables are actual values, in particular the engine speed, the fuel quantity supplied to the internal combustion engine and the operating temperature, charging pressure and exhaust gas recirculation parameters. The characteristic process variable may be, in particular, the torque or the engine speed.

The estimate is compared with a corresponding actual value that is determined from one of the measured state variables. The actual value gives the rotational acceleration contribution of each individual cylinder. A controller corrects the combustion in the individual cylinders in such a way that the actual value approaches the desired value. The different contributions of the individual cylinders are thus compensated for. As a further advantage of the method according to the invention, the regulation for a smooth running engine takes effect both for stationary and non-stationary operating phases of the internal combustion engine.

In accordance with an added feature of the invention, there are the steps of adapting the model at stationary operating points for variations in controlled system parameters; averaging the desired value estimated by the model in an averaging element for deriving an averaged desired value; determining a corresponding actual value for the stationary operating points with an adaptation function; and modifying the model so that a difference between the averaged desired value and the corresponding actual value is zero.

In accordance with an additional feature of the invention, there is the step of modifying the model to compensate for an aging phenomena of the internal combustion engine in the adapting step.

In accordance with another feature of the invention, there is the step of outputting an error state if the controller cannot correct the combustion in the individual cylinders and minimize the regulating difference.

In accordance with a further added feature of the invention, there is the step of using a torque parameter for the desired value and the actual value.

In accordance with a further additional feature of the invention, there is the step of using an engine speed parameter for the desired value and the actual value.

In accordance with a concomitant feature of the invention, there is the step of using an inverse linear path model stored in a form of characteristic diagrams as the model.

Other features which are considered as characteristic for the invention are set forth in the appended claims.

Although the invention is illustrated and described herein as embodied in a method for regulating a smooth running of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
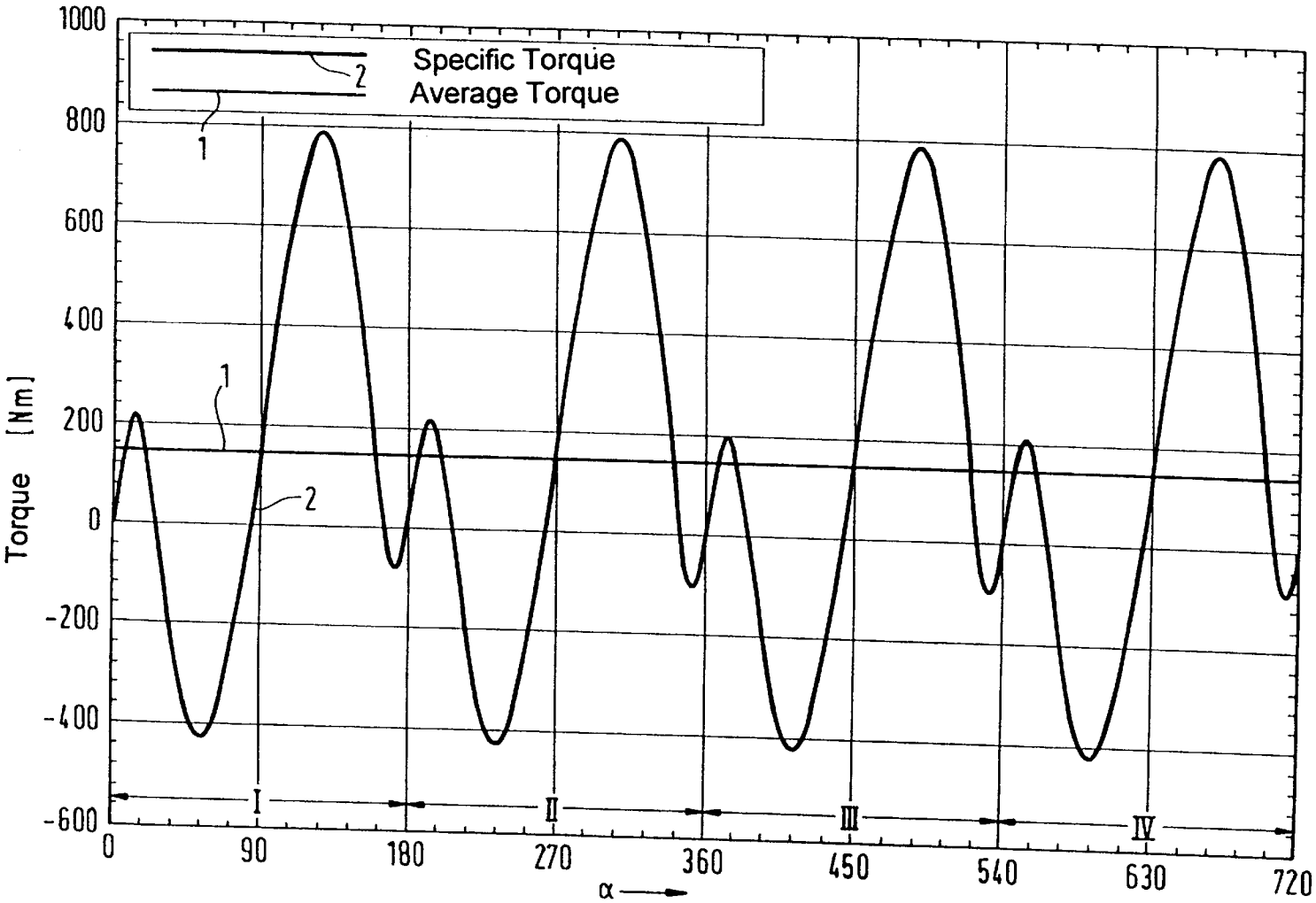
FIG. 1 is a graph of an average torque and a cylinder-specific torque of an internal combustion engine according to the invention.

Referring now to the figures of the drawing in detail and first, particularly, to FIG. 1 thereof, there is shown an average torque of an internal combustion engine and a specific torque of the individual cylinders plotted against a crankshaft position or angle. As can be seen, the cylinders I to IV of a four cylinder engine make different contributions to the average torque which is illustrated by Curve 1. Curve 2, namely the specific torque, runs through a pattern that is repeated after each work cycle. The contributions of the individual cylinders are designated by I, II, III and IV. The aim of the method according to the invention is to compensate for systematically induced different torque contributions by changing a metering of fuel into the individual cylinders, in such a way that all the cylinders have the same average output torque. The method, illustrated here for a four cylinder engine, may, of course, also be used for internal combustion engines having any number of cylinders.

Figure 2:
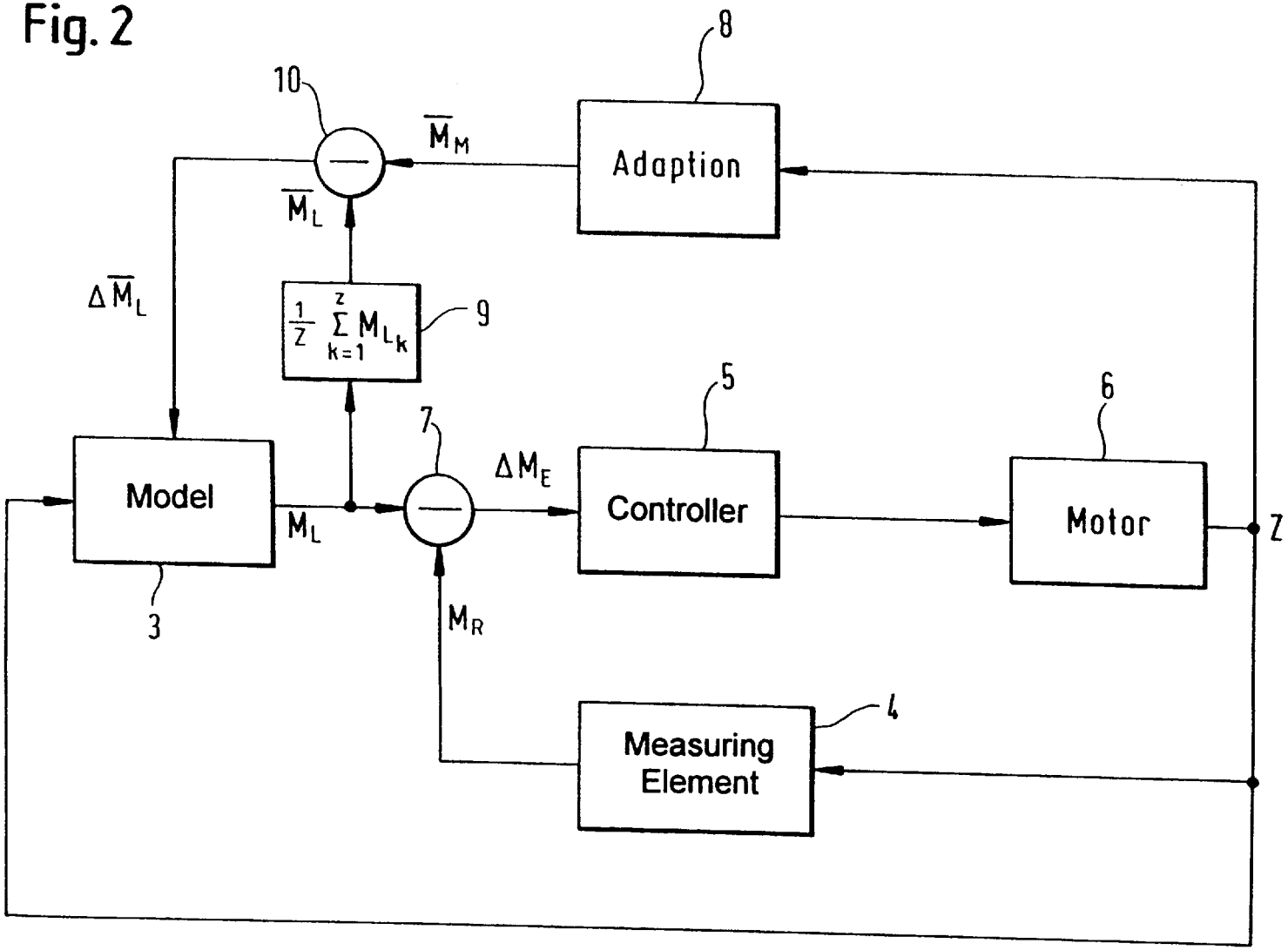
FIG. 2 is a block diagram of a regulating method for the internal combustion engine.

FIG. 2 shows a block diagram of a device for carrying out the regulating method. A model 3 is an inverse linear path model that is stored in the form of characteristic diagrams or differential equations. The model 3 estimates a characteristic process variable (a desired value) $M_L$, for example an expected change in rotational speed of the crankshaft, from state variables Z (for example, the engine speed, injected fuel mass, charging pressure, torque) of the internal combustion engine 6. A measuring element 4 measures the actual rotational speed and from this the measuring element 4 calculates a change in the rotational speed (rotational acceleration). The actual value $M_R$ records the rotational acceleration contribution of each individual cylinder. A difference element 7 calculates from the desired value $M_L$ and the actual value $M_R$ a regulating difference $\Delta M_E$ that is supplied to a controller 5. The controller 5 supplies to each cylinder a fuel mass such that the regulating difference $\Delta M_E$ is minimized. A circuit 8, 9, 10, which is still to be discussed, is also provided in FIG. 2 for adapting the model 3.

FIG. 3 shows the profile of relevant variables of the regulating method according to the invention. In FIG. 3*a*, the mass m of fuel supplied to the internal combustion engine is plotted against the time t. At a time point $t_1$, the fuel mass m is increased linearly as far as a time point $t_2$ by varying the position of an accelerator pedal. At a time point $t_3$, the allocated fuel mass is reduced again to the original value as far as a time point $t_4$. FIG. 3*b* plots the associated engine speed profile N. From the time point $t_1$, the engine speed increases to a maximum value, and, from $t_3$, when the driver brings back the accelerator pedal, it falls to the original value. FIG. 3*d* illustrates the characteristic process variable $M_L$ estimated by the process model 3 from the state variables describing the internal combustion engine. The model 3 estimates the characteristic process variable with the aid of an inverse linear path model that is stored in the form of characteristic diagrams. In the exemplary embodiment, the model 3 estimates the change in the engine speed, that is to say the profile of the rotational acceleration $M_L$. In order to estimate the rotational acceleration profile $M_L$, the model 3 uses measured state variables Z of the internal combustion engine, such as the engine speed and injected fuel mass. However, further measured state variables Z, such as, for example, charging pressure, exhaust gas recirculation, injection start angle, etc., can also be envisaged. The output torque of the internal combustion engine may also be considered as the characteristic process variable $M_L$. The characteristic variable $M_L$ is corrected, for example with regard to environmental influences (coolant temperature), within the model 3.

Figure 3A:
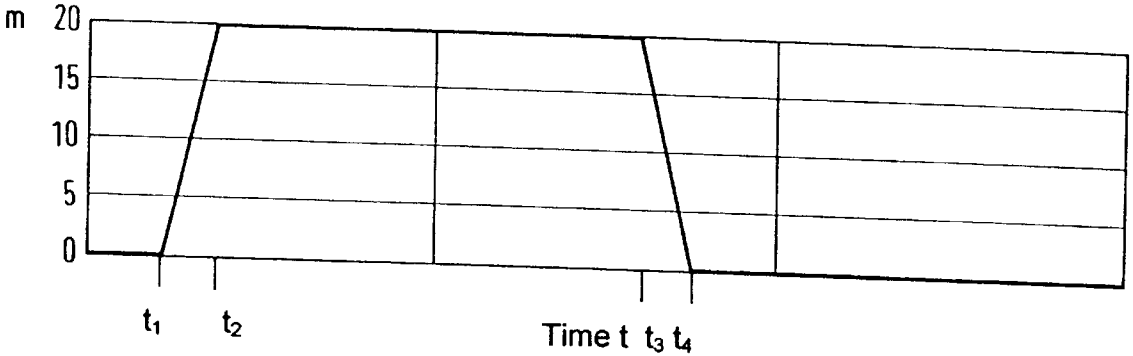
FIG. 3*a* is a graph of a time profile of a supplied fuel mass.
Figure 3B:
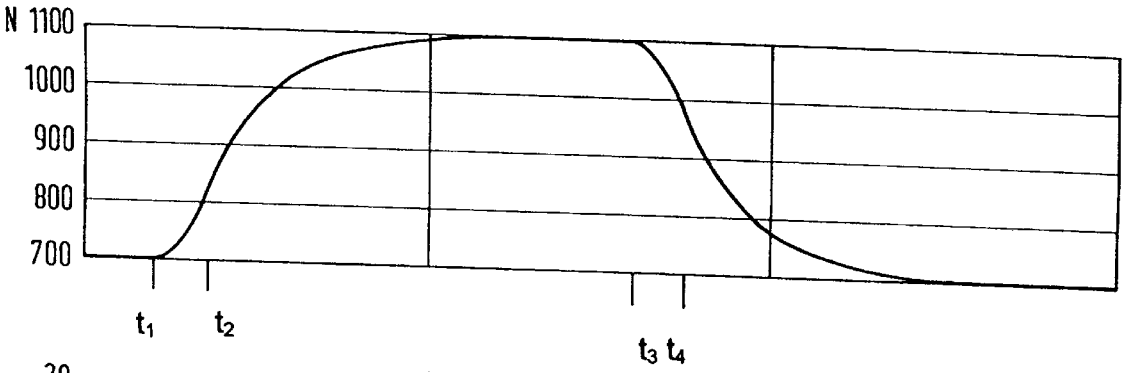
FIG. 3*b* is a graph of the time profile of an engine speed.
Figure 3C:
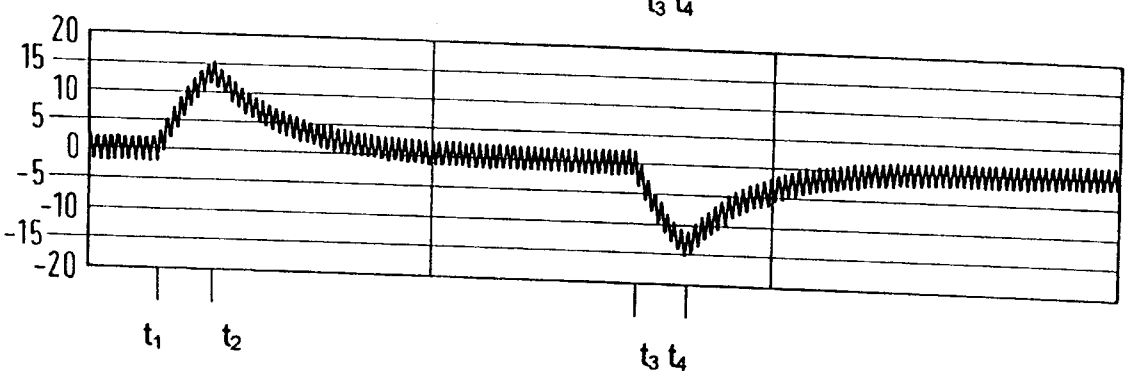
FIG. 3*c* is a graph of the time profile of an actual value $M_R$ determined from a measured state variable.
Figure 3D:
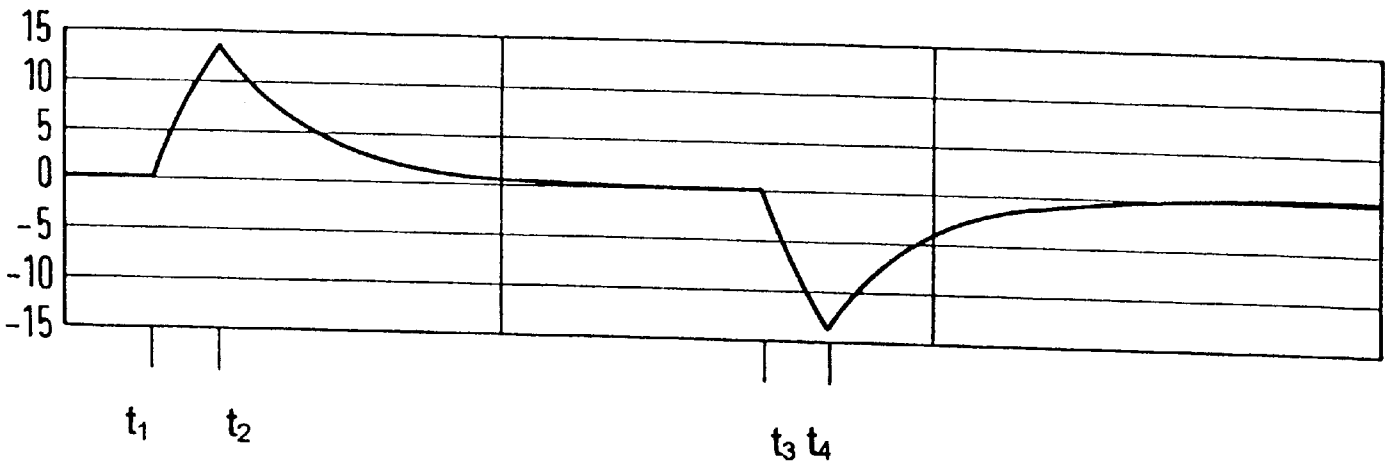
FIG. 3*d* is a graph of a value of an estimated characteristic process variable $M_L$.

FIG. 3*c* illustrates the time profile of the change in the rotational speed. The measuring element 4 measures the rotational speed and calculates the change in the rotational speed. The actual value $M_R$ thus represents the rotational acceleration contribution of each individual cylinder. FIG. 3*c* shows a serrated curve profile, the tips of the serrations in each case reproducing the contribution of each individual cylinder. In the difference element 7, a regulating difference $\Delta M_E$ for the controller 5 is formed from the actual value $M_R$ and the desired value $M_L$ of the change in rotational speed, the desired value being estimated by the model 3. For this purpose, the model 3 must estimate the characteristic process variable with a time resolution that corresponds to the time resolution of the actual values.

Figure 3E:
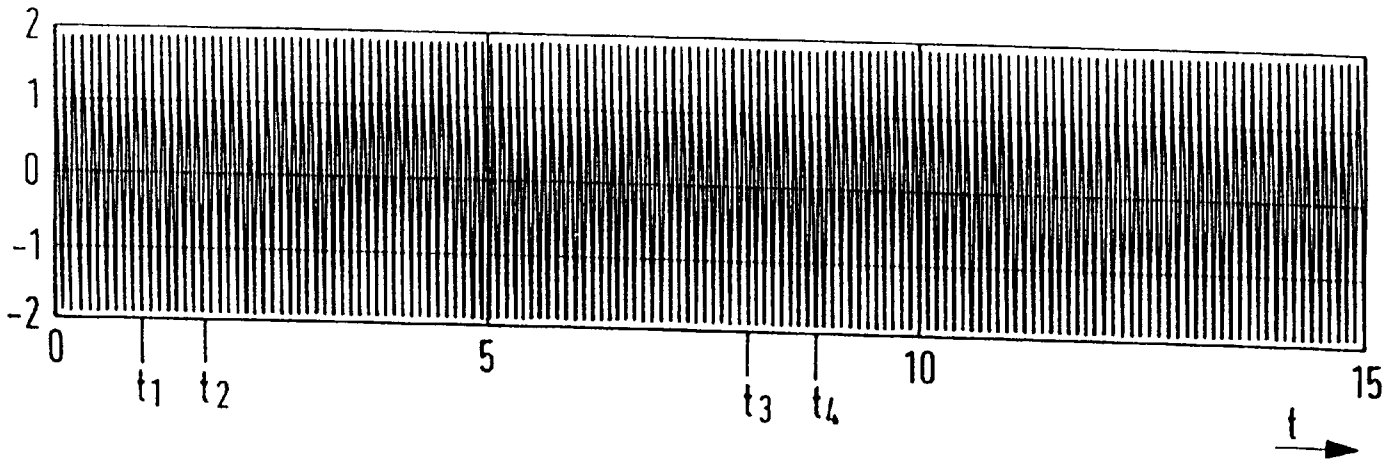
FIG. 3*e* is a graph of the time profile of a regulating difference $\Delta M_E$.

In FIG. 3*e*, the regulating difference $\Delta M_E$ is plotted against time. As can be seen, it is completely independent of whether the internal combustion engine is running in a stationary operating state (before the time point $t_1$) or in a non-stationary operating phase, that is to say between $t_1$ and $t_2$. The regulating difference $\Delta M_E$ expresses only the contributions of the individual cylinders to irregular running. Each serration is assigned to the contribution of a cylinder. The controller 5 is consequently in a position to correct the combustion operation in the individual cylinders of the internal combustion engine, in such a way that the regulating difference $\Delta M_E$ becomes minimal. The manipulated variable for the internal combustion engine is the injected fuel mass. It is also conceivable, however, to use the injection time or any other variable which influences the output torque of the individual cylinder.

The individual regulating algorithms of the controller 5 should not, on average, vary the average output torque of the internal combustion engine, that is to say the method should not lead to any variation in the total output torque. Such torque variations occur, however, when the desired value estimation $M_L$ of the model 3 is not correct. Such an error may be caused, for example, on the machine side, in particular by aging phenomena, or by slowly varying environmental influences, such as, for example, the ambient pressure, which are not taken into account in the model 3. In a preferred embodiment, therefore, the model 3 is to be adapted at a stationary operating point, for example during idling or under full load. In a measuring element for adaptation 8 (FIG. 3), the change in the rotational speed $M_M$ is measured and is averaged over at least one work cycle of the internal combustion engine 6 to derive $/M_M$. Furthermore, the estimated process variable of the model 3 is averaged by an averaging element 9, and the averaged value $/M_L$, together with $/M_M$, gives a model error $\Delta M_L$ in a difference element 10. The model 3, then, is corrected in such a way that the recycled model error $\Delta M_L$ becomes zero.

If the controller 5 has not achieved its regulating aim of minimizing the variable $\Delta M_E$ or of ideally making it zero, an error message can be generated. The error state then indicates a malfunction of the corresponding cylinder, for example, insufficient compression or damage in the injection system.

We claim:

1. A method for regulating a smooth running of a multi-cylinder internal combustion engine, which comprises:

measuring continuously determined state variables of an internal combustion engine having individual cylinders;

using the state variables in a model for estimating a characteristic process variable representing a desired value for regulating the internal combustion engine;

determining an instantaneous actual value corresponding to the desired value from the state variables, the actual value taking into account a rotational acceleration contribution of each of the individual cylinders;

deriving a regulating difference from the desired value and the actual value;

transmitting the regulating difference to a controller;

correcting with the controller a combustion in the individual cylinders for minimizing the regulating difference; and outputting an error state if the controller cannot minimize the regulating difference by correcting the combustion in the individual cylinders.

2. A method for regulating a smooth running of a multi-cylinder internal combustion engine, which comprises:

measuring continuously determined state variables of an internal combustion engine having individual cylinders;

using the state variables in a model for estimating a characteristic process variable representing a desired value for regulating the internal combustion engine;

recording a rotational acceleration of each individual cylinder;

determining an instantaneous actual value corresponding to the desired value from the state variables, the actual value taking into account a rotational acceleration contribution of each of the individual cylinders;

deriving a regulating difference from the desired value and the actual value;

transmitting the regulating difference to a controller; and correcting with the controller a combustion in the individual cylinders for minimizing the regulating difference by changing a fuel quantity allocated to each individual cylinder thereby compensating for deviations between the individual cylinders.

3. The method according to claim 2, which comprises outputting an error state if the controller cannot minimize the regulating difference by correcting the combustion in the individual cylinders.

4. The method according to claim 2, which comprises using a torque parameter for the desired value and the actual value.

5. The method according to claim 2, which comprises using an engine speed parameter for the desired value and the actual value.

6. The method according to claim 2, which comprises using an inverse linear path model stored in a form of characteristic diagrams as the model.

7. The method according to claim 2, which comprises:

adapting the model at stationary operating points for variations in controlled system parameters;

averaging the desired value estimated by the model in an averaging element for deriving an averaged desired value;

determining a corresponding actual value for the stationary operating points with an adaptation function; and modifying the model so that a difference between the averaged desired value and the corresponding actual value is zero.

8. The method according to claim 7, which comprises modifying the model to compensate for an aging phenomena of the internal combustion engine in the adapting step.

* * * * *